US007392628B2

(12) United States Patent
Logan et al.

(10) Patent No.: US 7,392,628 B2
(45) Date of Patent: Jul. 1, 2008

(54) FUNCTIONAL SHUTTER

(75) Inventors: Richard J. Logan, Oxford, MI (US); Nathan Greenway, Metamora, MI (US); Clyde G. Allen, Lapeer, MI (US); Charles E. Schiedegger, Metamora, MI (US)

(73) Assignee: Tapco International Corporation, Wixom, MI (US)

( * ) Notice: Subject to any disclaimer, the term of this patent is extended or adjusted under 35 U.S.C. 154(b) by 280 days.

(21) Appl. No.: 11/326,111

(22) Filed: Jan. 5, 2006

(65) Prior Publication Data

US 2006/0168889 A1 Aug. 3, 2006

Related U.S. Application Data

(60) Provisional application No. 60/641,681, filed on Jan. 6, 2005.

(51) Int. Cl.

| | |
|---|---|
| ***E06B 7/08*** | (2006.01) |
| ***E06B 3/70*** | (2006.01) |
| ***E06B 7/086*** | (2006.01) |
| ***E04B 1/34*** | (2006.01) |
| ***E04B 7/16*** | (2006.01) |

(52) U.S. Cl. ..... 52/473; 52/78; 52/455; 52/457; 49/74.1; 49/92.1

(58) Field of Classification Search ..... 52/78, 52/202, 455–457, 473; 49/64, 74.1, 92.1, 49/371, 403, 505

See application file for complete search history.

(56) References Cited

U.S. PATENT DOCUMENTS

| | | | | |
|---|---|---|---|---|
| 2,962,956 | A * | 12/1960 | Magyar | 454/281 |
| 3,968,738 | A | 7/1976 | Matzke | |
| 3,991,533 | A | 11/1976 | Nagase | |
| 4,251,966 | A | 2/1981 | Foltman | |
| 4,756,350 | A | 7/1988 | Turner | |
| 4,765,110 | A | 8/1988 | MacLeod | |
| 4,939,880 | A | 7/1990 | Wang | |
| 4,967,511 | A | 11/1990 | Werginz et al. | |
| 5,060,442 | A | 10/1991 | Chubb | |
| 5,152,116 | A | 10/1992 | MacGowan | |
| 5,163,260 | A | 11/1992 | Ricard et al. | |
| 5,191,735 | A | 3/1993 | Ross | |
| 5,216,837 | A * | 6/1993 | Cleaver et al. | 49/82.1 |
| 5,339,591 | A | 8/1994 | Underdahl | |
| 5,392,561 | A | 2/1995 | Henley, Sr. | |
| 5,490,353 | A | 2/1996 | McLaughlin | |

(Continued)

*Primary Examiner*—Brian Glessner
*Assistant Examiner*—Branon C Painter
(74) *Attorney, Agent, or Firm*—Howard & Howard Attorneys, P.C.

(57) ABSTRACT

A shutter assembly mounts to a building and includes a right stile and a left stile disposed in spaced opposing relationship with one another. A first bar is mounted to the right stile and presents at least one recess facing outwardly away from the right stile for receiving a decorative member. A second bar opposing the first bar is mounted to the left stile and presents at least one recess facing and opposing the recess of the first bar for receiving the decorative member. The first and second bars each have at least one biasing device extending into the respective recesses of the first and second bars and engage the decorative member for biasing the decorative member outwardly away from the respective stiles to prevent movement of the decorative member relative to the stiles.

24 Claims, 7 Drawing Sheets

U.S. PATENT DOCUMENTS 5,704,182 A 1/1998 Schiedegger
5,761,865 A 6/1998 Schiedegger et al.
5,778,598 A * 7/1998 Ohanesian ..... 49/74.1
5,826,393 A 10/1998 Wenzlaff et al.
5,848,505 A 12/1998 Taylor
5,887,386 A 3/1999 Alexanian et al.
5,907,929 A * 6/1999 Poma et al. ..... 52/78
5,924,255 A 7/1999 Vagedes
5,946,873 A 9/1999 Schiedegger et al.
5,996,298 A 12/1999 Wenzlaff et al.
6,023,905 A 2/2000 Schiedegger
6,122,875 A 9/2000 Schiedegger et al.
6,141,938 A 11/2000 Schiedegger
6,145,251 A 11/2000 Ricci
6,148,575 A 11/2000 Dingler
6,263,632 B1 7/2001 Cadorette
6,314,680 B1 11/2001 Buckwalter et al.
6,378,262 B1 4/2002 Mercadante
6,487,827 B2 12/2002 Hollman
6,536,174 B2 3/2003 Foster et al.
6,543,188 B1 4/2003 Poma et al.
6,560,941 B1 * 5/2003 French ..... 52/473
6,604,322 B2 8/2003 Horn et al.
6,622,433 B2 9/2003 Blachley
6,655,091 B1 12/2003 Iwasaki
6,722,415 B2 4/2004 Mochizuki et al.
6,732,475 B1 5/2004 Lee
6,810,619 B2 11/2004 Wilson
6,817,141 B2 11/2004 Chen
6,820,385 B2 11/2004 Horn et al.
6,854,211 B1 2/2005 Blachley
6,877,285 B2 4/2005 Poma et al.
2003/0009946 A1 1/2003 Wilson
2003/0115817 A1 6/2003 Blackwell et al.
2003/0200715 A1 10/2003 Blackwell et al.
2004/0003540 A1 1/2004 Horn et al.
2004/0010988 A1 1/2004 Jaycox et al.
2004/0068936 A1 4/2004 Amin-Javaheri
2004/0244291 A1 * 12/2004 Lee ..... 49/82.1
2005/0022463 A1 2/2005 Blackwell et al.
2005/0072089 A1 4/2005 Wong
2005/0210777 A1 9/2005 Baughn et al.

* cited by examiner

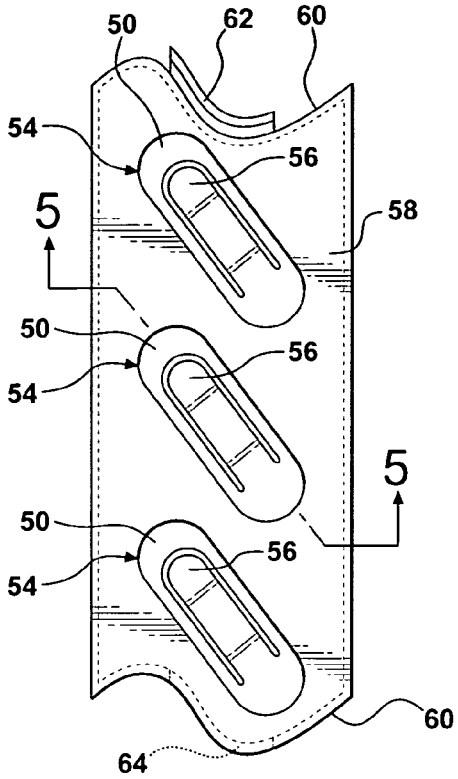
FIG - 4
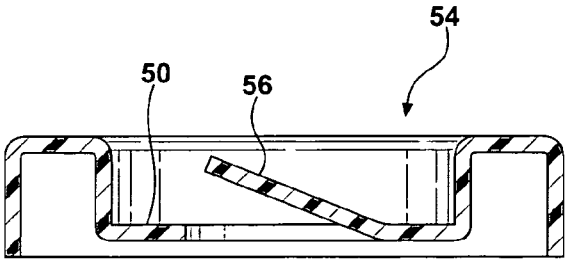
FIG - 5
FIG - 6
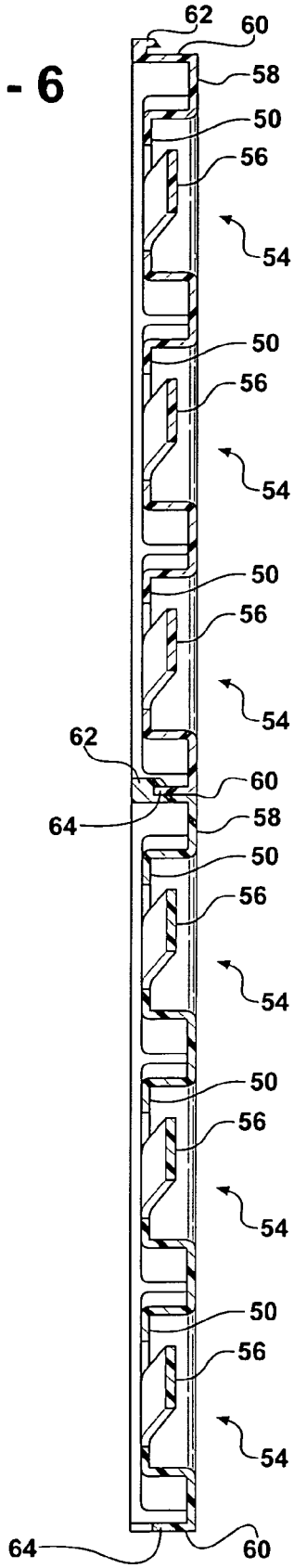

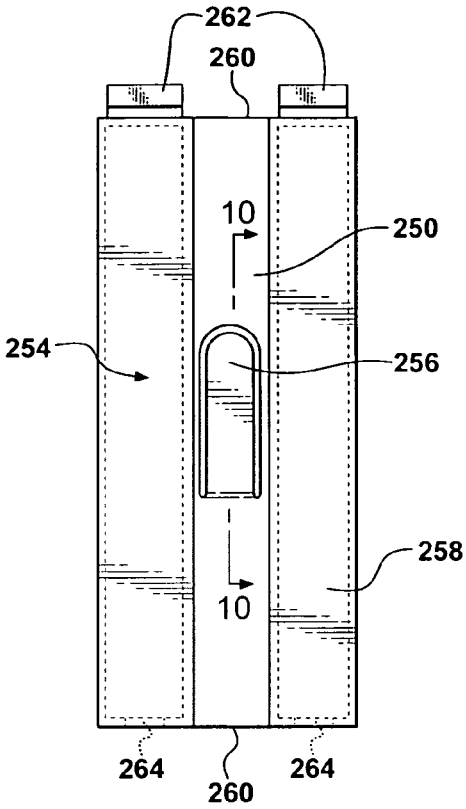
FIG - 9
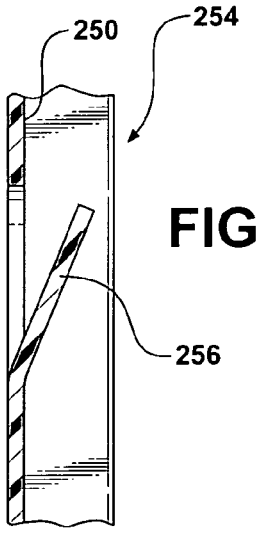
FIG - 10
FIG - 11
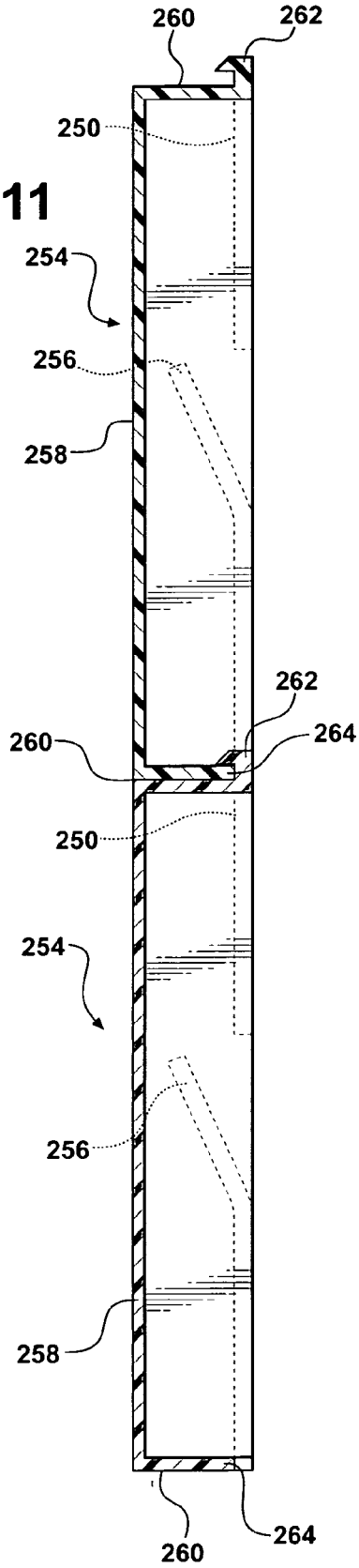

FUNCTIONAL SHUTTER

CROSS REFERENCE TO RELATED APPLICATION

This application claims the benefit of U.S. provisional application Ser. No. 60/641,681 filed Jan. 6, 2005.

BACKGROUND OF THE INVENTION

1. Field of the Invention

The invention relates to a shutter assembly for mounting to a building.

2. Description of the Prior Art

It is common for a building to use shutter assemblies adjacent window openings to increase the aesthetic appearance of the building. An example of such a configuration is shown in U.S. Pat. No. 4,939,880 (the '880 patent) to Wang. The shutter assembly disclosed in the '880 patent includes at least one decorative member coupled to and extending between a pair of stiles. Typically after assembly, the shutter is covered in paint, sealer, and/or stain. Thereafter, any movement of the shutter assembly causes the decorative member to move within the stiles which chips off paint and/or sealer disposed thereon or exposes unpainted and/or unsealed areas, thus decreasing the aesthetic appeal of the decorative member.

Therefore, there remains a need to develop a shutter assembly that prevents the decorative member from moving within the stiles and ultimately preserves the aesthetic appearance of the decorative member.

SUMMARY OF THE INVENTION AND ADVANTAGES

The present invention provides a shutter assembly for mounting to a building. The shutter assembly includes a right stile and a left stile disposed in spaced opposing relationship with one another. A top rail and a bottom rail in spaced relationship with each other extend between the right and left stiles. At least one decorative member is disposed between and coupled to the right and left stiles and the top and bottom rails. A first bar is mounted to the right stile and presents at least one recess facing outwardly away from the right stile for receiving the decorative member. A second bar spaced from and opposing the first bar is mounted to the left stile and presents at least one recess facing and opposing the recess of the first bar for receiving the decorative member. The first and second bars each have at least one biasing device extending into the respective recesses of each of the first and second bars and engage the decorative member for biasing the decorative member outwardly away from the respective right and left stiles to prevent movement of the decorative member relative to the stiles.

The present invention therefore provides for a biasing device to prevent movement of a decorative member relative to a right stile and a left stile to prevent paint and/or sealer from chipping off, prevent unpainted areas from being exposed, and ultimately preserve the aesthetic appearance of the decorative member. In addition, a first bar and a second bar make assembly of a shutter easier because a plurality of decorative members may be coupled to the bars before assembly and inserted together into the stiles.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 is a front view of a bar portion having a biasing device disposed within each of a plurality of recesses;

FIG. 5 is a cross-sectional view of one of the recesses of the bar portion taken along line 5-5 of FIG. 4;

FIG. 6 is a cross-sectional view of a plurality of bar portions fastened together;

FIG. 9 is a front view of a bar portion taken along line 10-10 of FIG. 9;

FIG. 10 is a cross-sectional view of the recess of the bar portion having the biasing device disposed therein; and FIG. 11 is a cross-sectional view of a plurality of bar portions fastened together.

DETAILED DESCRIPTION OF THE INVENTION

Figure 1:
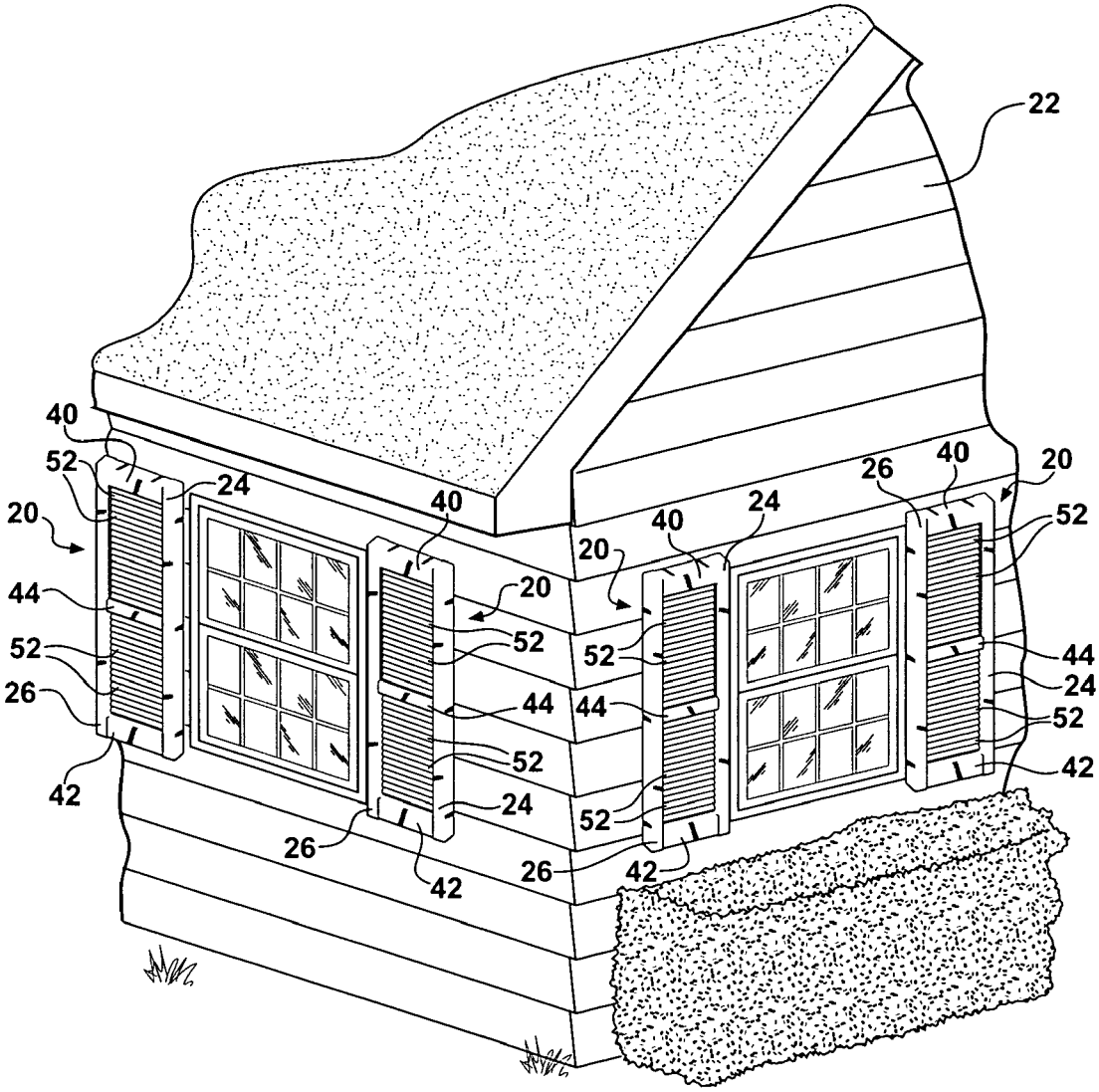
FIG. 1 is a partial perspective view of a building having a first embodiment of a plurality of shutter assemblies disposed thereon and commonly referred to as a louvered shutter.
Figure 2:
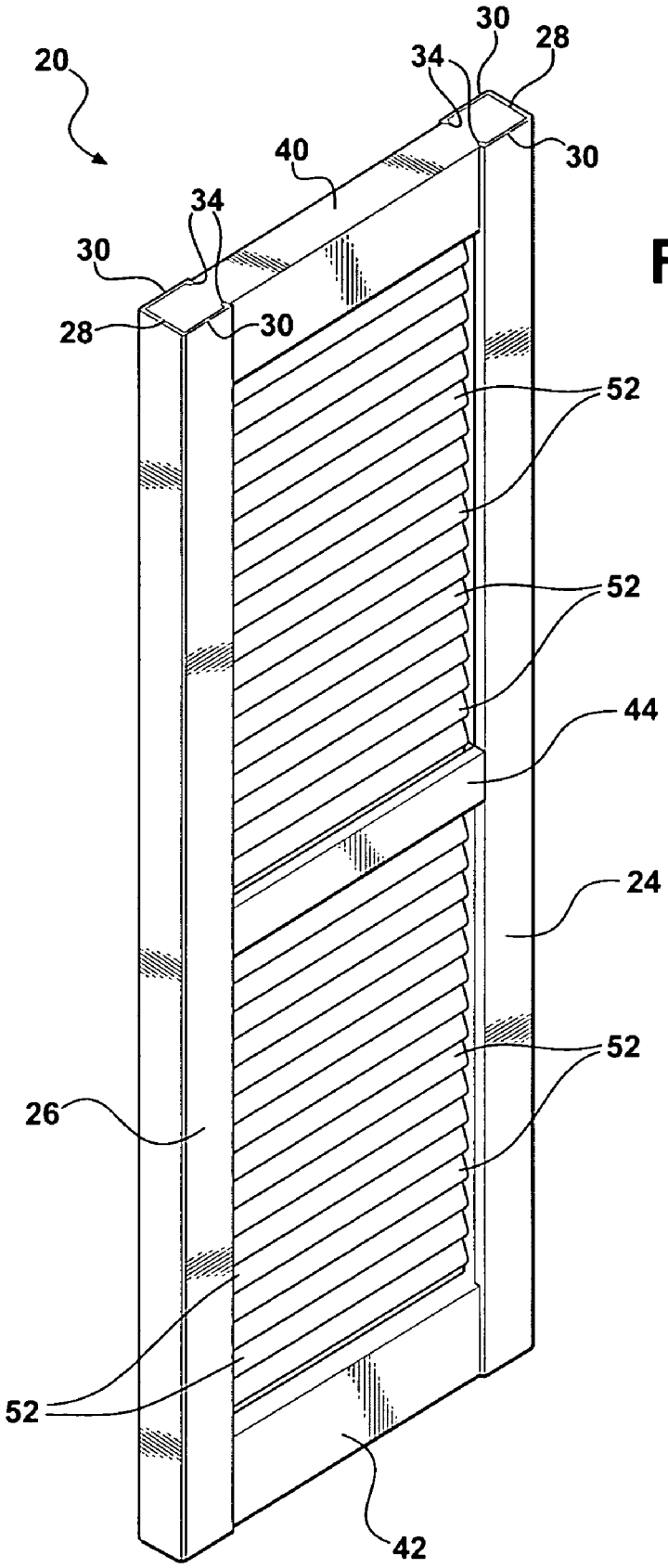
FIG. 2 is a perspective view of the louvered shutter.

Referring to the Figures, wherein like numerals indicate corresponding parts throughout the several views, a shutter assembly 20 for mounting to a building 22 is generally shown in FIG. 1.

Referring to FIGS. 1-6, a first embodiment of the shutter assembly 20 is shown, which is commonly referred to as a louvered shutter. The shutter assembly 20 includes a right stile 24 and a left stile 26 disposed in spaced opposing relationship with one another. The right stile 24 is preferably a mirror image of the left stile 26. Each of the stiles 24, 26 has a base 28 with side walls 30 extending therefrom. The side walls 30 of each of the stiles 24, 26 extend to spaced distal edges to define a channel 32 having a U-shaped cross section. Each of the distal edges of the side walls 30 include a flange 34 extending inwardly into the channel 32 of each of the respective right and left stiles 24, 26. Each of the stiles 24, 26 has a divider 36 in parallel and spaced relationship with the flanges 34 to define an elongated pocket 38 therebetween. Preferably, the stiles 24, 26 are formed of a pultruded fiberglass reinforced plastic (FRP). Alternatively, the stiles 24, 26 may be formed of a composite material, an extruded polyvinyl chloride (PVC) plastic, medium density fiberboard (MDF), wood, or any other acceptable material or process known in the art.

The shutter assembly 20 further includes a top rail 40 and a bottom rail 42 extending between the stiles 24, 26 in spaced relationship to each other. The top rail 40 is preferably a mirror image of the bottom rail 42. Preferably, the rails 40, 42 are formed of PVC or MDF and cut and machined to the appropriate size. It is contemplated that the rails 40, 42 may be extruded or formed of any other acceptable material or process known in the art.

A first bar, generally shown at 46, is mounted to at least one of the right stile 24 and the top rail 40. A second bar, generally shown at 48, is spaced from and opposing the first bar 46 and mounted to at least one of the left stile 26 and the bottom rail 42. Preferably, the first bar 46 is mounted to the right stile 24 and the second bar 48 is mounted to the left stile 26. Even more preferably, the first bar 46 is disposed between the flanges 34 and the base 28 of the right stile 24 and the second bar 48 is disposed between the flanges 34 and the base 28 of the left stile 26. In the most preferred embodiment, the first bar 46 is disposed within the elongated pocket 38 between the flanges 34 and the divider 36 of the right stile 24 and second bar 48 is disposed within the elongated pocket 38 between the flanges 34 and the divider 36 of the left stile 26. Although not shown, it is contemplated that the first bar 46 may be formed of a homogenous material with one of the right stile 24 and the top rail 40 and the second bar 48 may be formed of a homogenous material with one of the left stile 26 and the bottom rail 42. Preferably, the first and second bars 46, 48 are formed of injection molded PVC plastic. However, it is to be appreciated that the first and second bars 46, 48 may be extruded or formed of acrylonitrile butiadene styrene (ABS) plastic or any other acceptable material or process known in the art.

As best shown in FIGS. 3-6, the first bar 46 presents at least one recess facing outwardly away from the right stile 24 for receiving a portion of at least one decorative member. The second bar 48 presents at least one recess facing and opposing the recess of the first bar 46 for receiving a portion of the decorative member. In the embodiment of FIGS. 1-6, the at least one recess defined by each of the first and second bars 46, 48 is further defined as a plurality of slat recesses 50. The slat recesses 50 are elongated along an axis disposed at an angle to the length of the right and left stiles 24, 26. One skilled in the art will appreciate that the slat recesses 50 of the first bar 46 are inverse to the slat recesses 50 of the second bar 48.

The decorative member is disposed between and coupled to the stiles 24, 26 and the rails 40, 42. A mullion 44 may extend between the stiles 24, 26 and spaced between the rails 40, 42 for separating at least two decorative members. However, one skilled in the art will appreciate that the mullion 44 is optional. Preferably, the mullion 44 is formed of PVC or MDF and cut and machined to the appropriate size. It is contemplated that the mullion 44 may be extruded or formed of any other acceptable material or process known in the art.

In the embodiment of FIGS. 1-6, the decorative member is further defined by a plurality of slats 52 having a cross section complementary to the slat recesses 50 for retaining the slats 52 within the slat recesses 50. The slats 52 are preferably formed of a pultruded FRP. It is contemplated that the slats 52 may be formed of an extruded PVC plastic, and any other acceptable material or process known in the art.

Referring to FIG. 4-6, either the first bar 46 or the second bar 48 may be shown. However, only the first bar 46 is shown for illustrative purposes and the slat recesses 50 of the first bar 46 is inverse to the slat recesses 50 of the second bar 48. The first and second bars 46, 48 each have at least one biasing device generally shown at 54. The biasing device 54 extends into the respective slat recesses 50 of the first and second bars 46, 48. The biasing device 54 engages the slats 52 for biasing the slats 52 outwardly away from the respective stiles 24, 26 and the rails 40, 42 to prevent movement of the slats 52 relative to the stiles 24, 26 and the rails 40, 42. Preferably, the biasing device 54 prevents movement of the slats 52 relative to the stiles 24, 26 for preventing paint and/or sealer from chipping off the slats 52 and preventing unpainted areas from being exposed. Ultimately, the biasing device 54 preserves the aesthetic appearance of the slats 52. The biasing device 54 of each of the first and second bars 46, 48 is further defined as a cantilevered finger 56 extending into the respective slat recesses 50 of each of the first and second bars 46, 48. However, it is to be appreciated that the biasing device 54 may be any kind of spring biasing mechanism.

Each of the first and second bars 46, 48 include a plurality of bar portions 58. The bar portions 58 each having at least one biasing device 54 disposed in each of the slat recesses 50 for biasing each of the slats 52 outwardly away from the respective right and left stiles 24, 26. The biasing device 54 of each of the bar portions 58 is further defined as a cantilevered finger 56 extending into the respective slat recesses 50 of each of the bar portions 58. Referring to FIG. 4, a single bar portion 58 is shown having three slat recesses 50 with one biasing device 54 disposed within each of the slat recesses 50.

Figure 3:
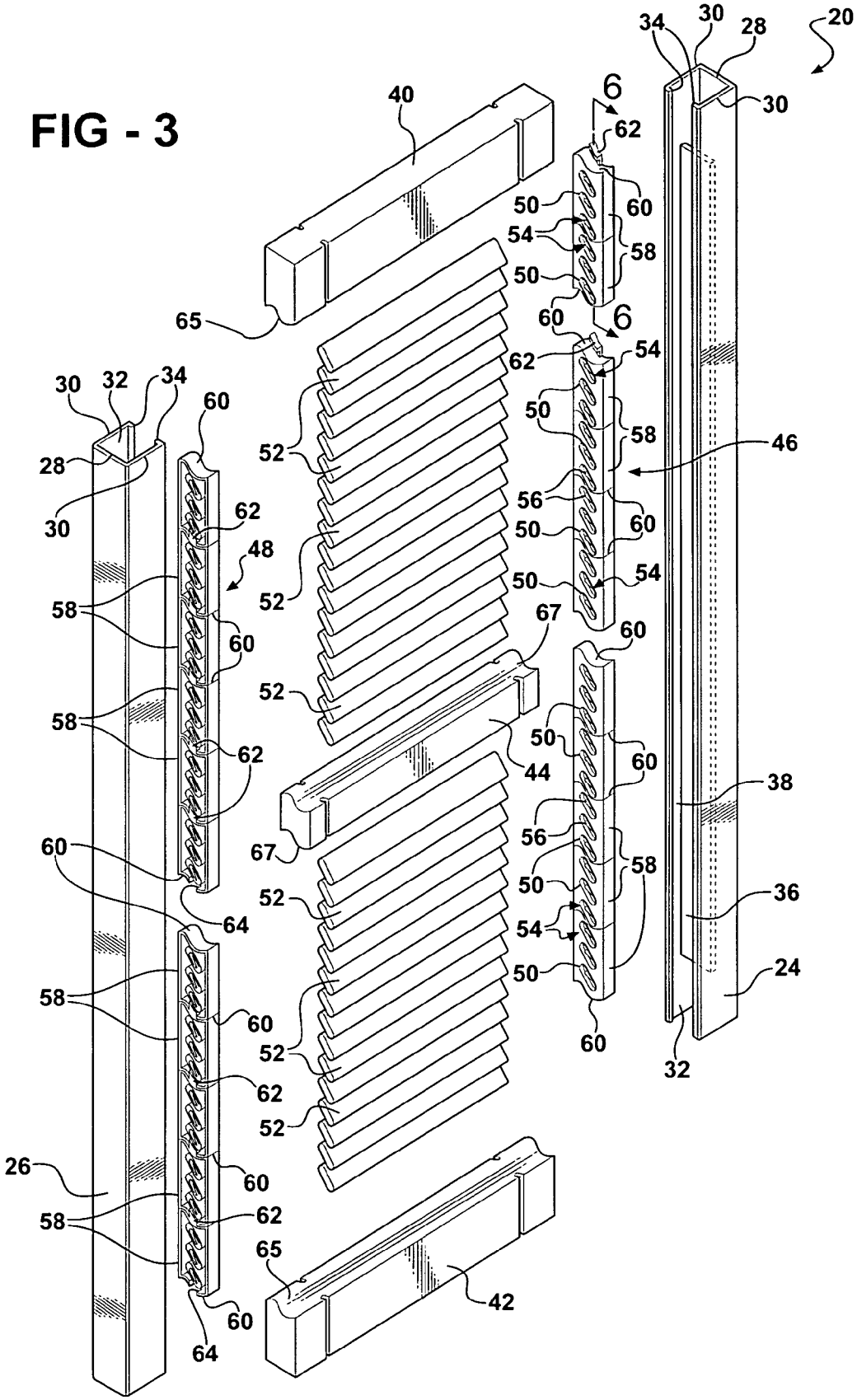
FIG. 3 is an exploded perspective view of the louvered shutter.

As shown in FIGS. 3, 4, and 6, each bar portion 58 includes opposing connector ends 60. The connector ends 60 have at least one male fastener 62 disposed on one of the connector ends 60 and at least one female fastener 64 disposed on the other connector end 60 for fastening the bar portions 58 together to form the first and second bars 46, 48. It is contemplated that the male and female fasteners 62, 64 may be hooks, clasps, snaps or any other acceptable fastening device to fasten the bar portions 58 together.

Each of the connector ends 60 of each bar portion 58 has a shaped end for abutting the shaped end of another bar portion 58 and providing proportionately spaced slat recesses 50 between each of the bar portions 58. As best shown in FIG. 4, each of the shaped ends of each bar portion 58 is further defined as an S-shaped configuration. However, it is to be appreciated that any other shaped configuration may be used to proportionately space the slat recesses 50 between each bar portion 58. The top and bottom rails 40, 42 each have a shaped side 65 complementary to the shaped ends of the bar portions 58. In addition, the mullion 44 has a pair of shaped sides 67 opposing one another and complementary to the shaped ends of the bar portions 58. The male and female fasteners 62, 64 facing the rails 40, 42 and the mullion 44 are cut off such that the shaped ends of the bar portions 58 abut each of the shaped sides 65 of the rails 40, 42 and the shaped sides 67 of the mullion 44.

Preferably, the shutter assembly 20 is made of a combination of MDF, extruded PVC plastic, injection molded ABS plastic, and/or pultruded FRP. However, one of ordinary skill in the art appreciates that other materials or processes may be used. The shutter assembly 20 may be covered with a sealer, paint, and/or stain. The shutter assembly 20 may be secured to the building 22 by any appropriate means known in the art. As appreciated by those skilled in the art, hinges (not shown) may be disposed on the outside of the stiles 24, 26. The hinges permit pivotal rotation of the shutter assembly 20 from an open position to a closed position or conversely, thus creating a functional shutter.

Figure 7:
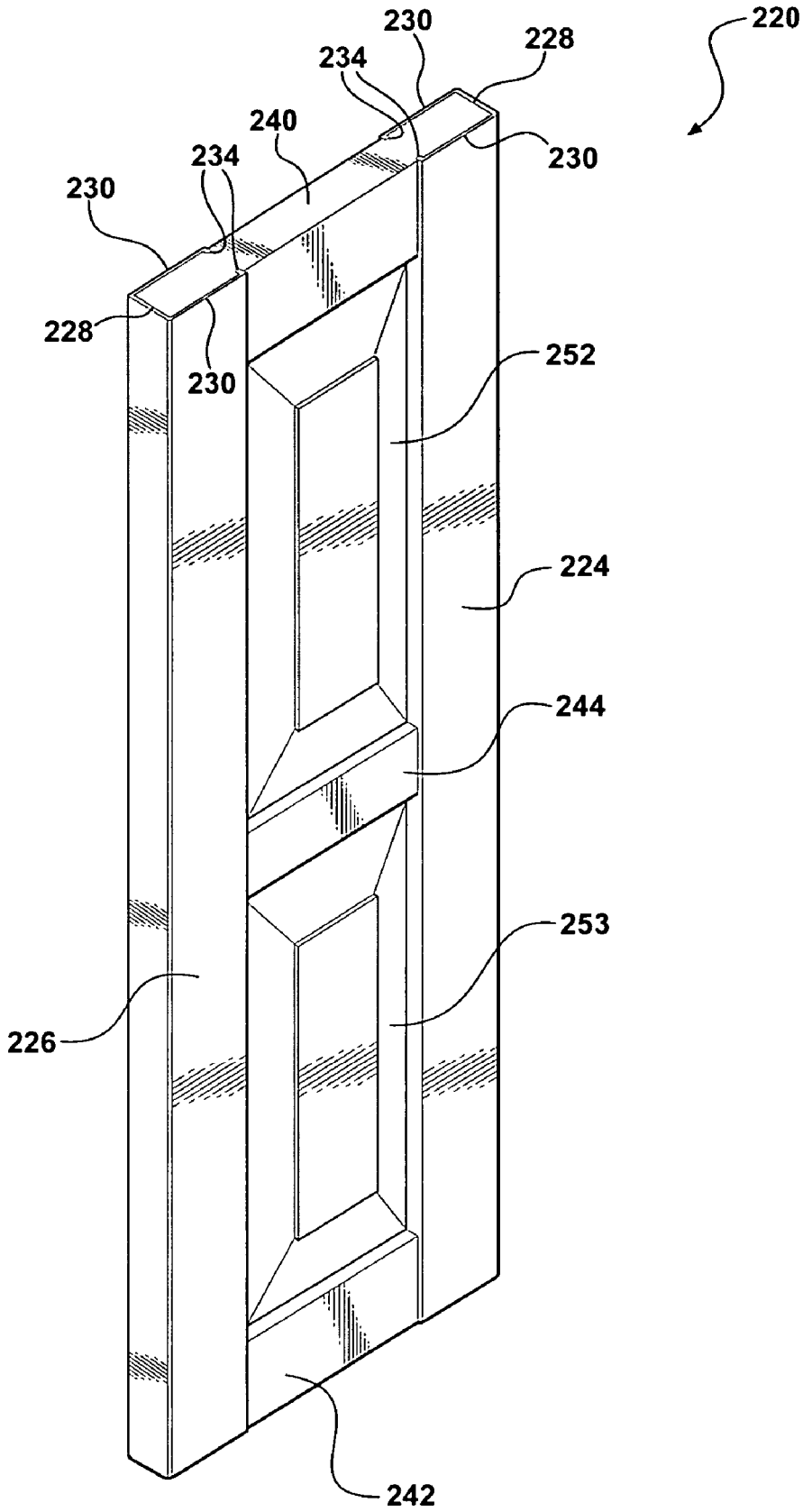
FIG. 7 is a perspective view of a second embodiment of the shutter assembly commonly referred to as a panel shutter.
Figure 8:
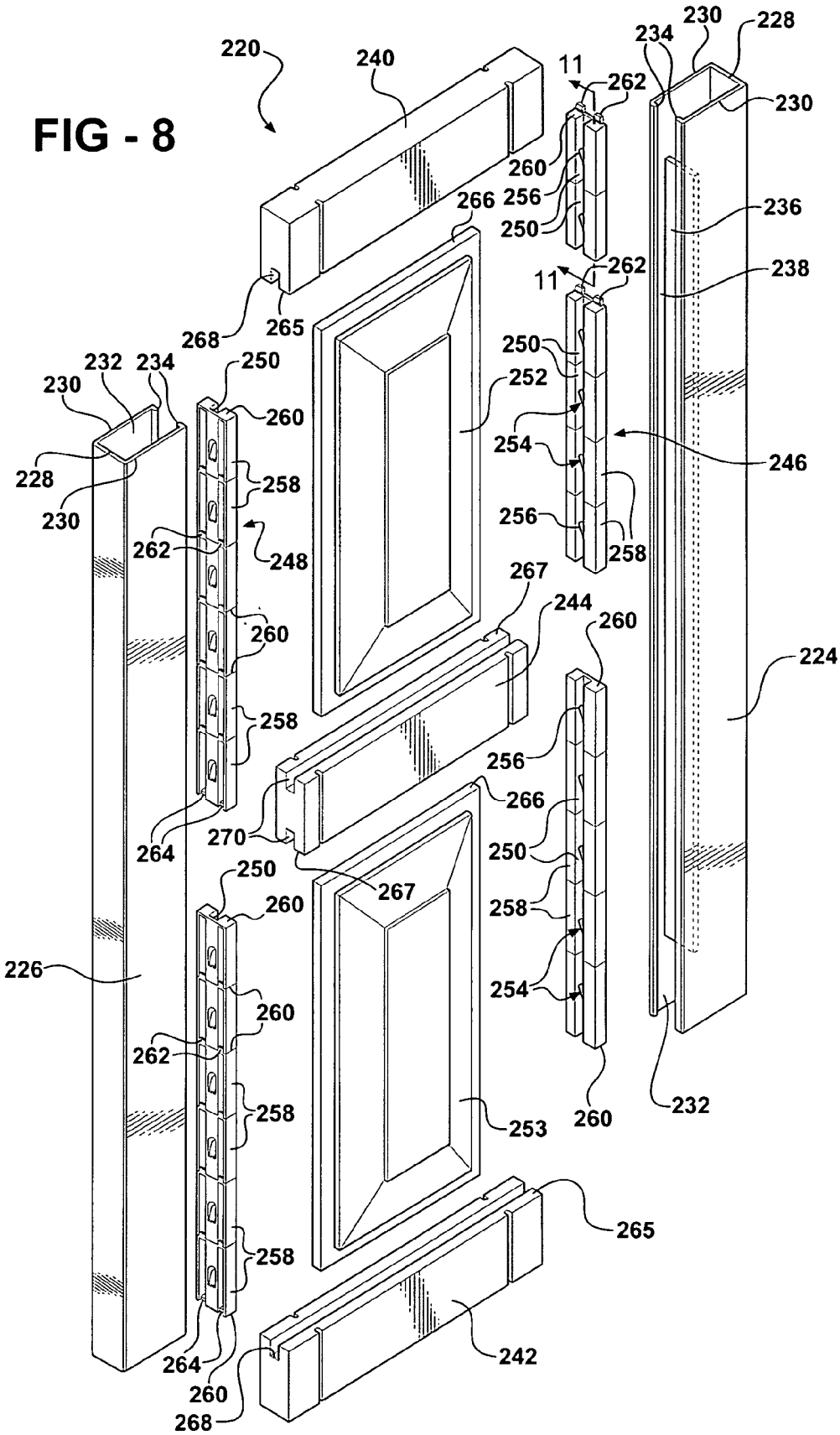
FIG. 8 is an exploded perspective view of the panel shutter.

A second embodiment of the shutter assembly 220, wherein like numerals increased by 200 indicate like or corresponding parts, is generally shown in FIGS. 7-11, which is commonly referred to as a panel shutter. The primary distinction between the panel shutter and the louvered shutter is the decorative member for the panel shutter is defined by at least one panel. As illustrated in FIGS. 7 and 8, the panel is further defined as a first panel 252 and a second panel 253 each having a periphery 266. As appreciated by those skilled in the art, the panel shutter may be constructed with only the first panel 252. The first and second panels 252, 253 are preferably formed of an extruded polyvinyl chloride (PVC) plastic. It is contemplated that the first and second panels 252, 253 may be formed of a medium density fiberboard (MDF), a pultruded fiberglass reinforced plastic (FRP), or any other acceptable material or process known in the art.

The shutter assembly 220 includes a right stile 224 and a left stile 226 disposed in spaced opposing relationship with one another. The right stile 224 is preferably a mirror image of the left stile 226. Each of the stiles 224, 226 has a base 228 with side walls 230 extending therefrom. The side walls 230 of each of the stiles 224, 226 extend to spaced distal edges to define a channel 232 having a U-shaped cross section. Each of the distal edges of the side walls 230 include a flange 234 extending inwardly into the channel 232 of each of the respective right and left stiles 224, 226. Each of the stiles 224, 226 has a divider 236 in parallel and spaced relationship with the flanges 234 to define an elongated pocket 238 therebetween. Preferably, the stiles 224, 226 are formed of a pultruded FRP. Alternatively, the stiles 224, 226 may be formed of a composite material, an extruded PVC plastic, MDF, wood, or any other acceptable material or process known in the art.

The shutter assembly 220 further includes a top rail 240 and a bottom rail 242 extending between the stiles 224, 226 in spaced relationship to each other. The top rail 240 is preferably a mirror image of the bottom rail 242. Each of the rails 240, 242 defines a panel recess 268 for receiving the periphery 266 of the first and second panel 252, 253. Preferably, the first panel 252 is disposed adjacent to the top rail 240 and the second panel 253 disposed adjacent to the first panel 252 and the bottom rail 242. A mullion 244 may extend between the stiles 224, 226 and spaced between the first and second panels 252, 253 for separating at least two decorative members. The mullion 244 defines a pair of opposing panel recesses 270 with the periphery 266 of the first panel 252 disposed in the corresponding panel recess 270 of the mullion 244 and the panel recess 268 of the top rail 240 and the periphery 266 of the second panel 253 disposed in the other panel recess 270 of the mullion 244 and the panel recess 268 of the bottom rail 242. However, one skilled in the art will appreciate that the mullion 244 is optional. Preferably, the rails 240, 242 and the mullion 244 are formed of PVC or MDF and cut and machined to the appropriate size. It is contemplated that the rails 240, 242 and the mullion 244 may be extruded or formed of any other acceptable material or process known in the art.

Referring to FIG. 8, a first bar, generally shown at 246, is mounted to at least one of the right stile 224 and the top rail 240. A second bar, generally shown at 248, is spaced from and opposing the first bar 246 and mounted to at least one of the left stile 226 and the bottom rail 242. Preferably, the first bar 246 is mounted to the right stile 224 and the second bar 248 is mounted to the left stile 226. Even more preferably, the first bar 246 is disposed between the flanges 234 and the base 228 of the right stile 224 and the second bar 248 is disposed between the flanges 234 and the base 228 of the left stile 226. In the most preferred embodiment, the first bar 246 is disposed within the elongated pocket 238 between the flanges 234 and the divider 236 of the right stile 224 and second bar 248 is disposed within the elongated pocket 238 between the flanges 234 and the divider 236 of the left stile 226. Although not shown, it is contemplated that the first bar 246 may be formed of a homogenous material with one of the right stile 224 and the top rail 240 and the second bar 248 may be formed of a homogenous material with one of the left stile 226 and the bottom rail 242. Preferably, the first and second bars 246, 248 are formed of injection molded PVC plastic. However, it is to be appreciated that the first and second bars 46, 48 may be extruded or formed of acrylonitrile butiadene styrene (ABS) plastic or any other acceptable material or process known in the art.

As best shown in FIGS. 8-11, the first bar 246 presents at least one recess 250 facing outwardly away from the right stile 224 for receiving a portion of the decorative member. The second bar 248 presents at least one recess 250 facing and opposing the recess 250 of the first bar 246 for receiving a portion of the decorative member. Preferably, the respective recesses 250 of the first and second bars 246, 248 received the periphery 266 of the first and second panels 252, 253. One skilled in the art will appreciate that the first bar 246 is preferably a mirror image of the second bar 248.

Referring to FIGS. 9-11, either the first bar 246 or the second bar 248 may be shown. However, only the first bar 246 is shown for illustrative purposes and the first bar 246 is preferably a mirror image of the second bar 248. The first and second bars 246, 248 each have at least one biasing device generally shown at 254. The biasing device 254 extends into the respective recesses 250 of the first and second bars 246, 248. The biasing device 254 engages the first and second panels 252, 253 for biasing the panels 252, 253 outwardly away from the respective stiles 224, 226 and the rails 240, 242 to prevent movement of the panels 252, 253 relative to the stiles 224, 226 and the rails 240, 242. Preferably, the biasing device 254 prevents movement of the first and second panels 252, 253 relative to the stiles 224, 226 for preventing paint and/or sealer from chipping off the panels 252, 253 and preventing unpainted areas from being exposed. Ultimately, the biasing device 254 preserves the aesthetic appearance of the panels 252, 253. The biasing device 254 of each of the first and second bars 246, 248 is further defined as a cantilevered finger 256 extending into the respective recesses 250 of each of the first and second bars 246, 248. However, it is to be appreciated that the biasing device 254 may be any kind of spring biasing mechanism.

Each of the first and second bars 246, 248 include a plurality of bar portions 258. Each of the bar portions 258 have at least one biasing device 254 disposed in each of the recesses 250 for biasing the first and second panels 252, 253 outwardly away from the respective right and left stiles 224, 226. The biasing device 254 of each of the bar portions 258 is further defined as a cantilevered finger 256 extending into the respective recesses 250 of each of the bar portions 258. Referring to FIG. 9, a single bar portion 258 is shown having a single recess 250 with one biasing device 254 disposed therein.

As shown in FIGS. 8, 9, and 1, each bar portion 258 includes opposing connector ends 260. The connector ends 260 have at least one male fastener 262 disposed on one of the connector ends 260 and at least one female fastener 264 disposed on the other connector end 260 for fastening the bar portions 258 together to form the first and second bars 246, 248. It is contemplated that the male and female fasteners 262, 264 may be hooks, clasps, snaps or any other acceptable fastening device to fasten the bar portions 258 together.

As best shown in FIG. 9, each of the connector ends 260 of each bar portion 258 has a shaped end for abutting the shaped end of another bar portion 258. However, it is to be appreciated that the shaped ends may be any shaped configuration. The top and bottom rails 240, 242 each have a shaped side 265 complementary to the shaped ends of the bar portions 258. In addition, the mullion 244 has a pair of shaped sides 267 opposing one another and complementary to the shaped ends of the bar portions 258. The male and female fasteners 262, 264 facing the rails 240, 242 and the mullion 244 are cut off such that the shaped ends of the bar portions 258 abut each of the shaped sides 265 of the rails 240, 242 and the shaped sides 267 of the mullion 244.

Preferably, the shutter assembly 220 is made of a combination of MDF, extruded PVC plastic, injection molded ABS plastic, and/or FRP. However, one of ordinary skill in the art appreciates that other materials or processes may be used. The shutter assembly 220 may be covered with a sealer, paint, and/or stain. The shutter assembly 220 may be secured to a building (not shown) by any appropriate means known in the art. As appreciated by those skilled in the art, hinges (not shown) may be disposed on the outside of the stiles 224, 226. The hinges permit pivotal rotation of the shutter assembly 220 from an open position to a closed position or conversely, thus creating a functional shutter.

The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A shutter assembly for mounting to a building, said assembly comprising:

a right stile and a left stile disposed in spaced opposing relationship with one another, a top rail and a bottom rail in spaced relationship with each other and extending between said right and left stiles, at least one decorative member disposed between and coupled to said right and left stiles and said top and bottom rails, a first bar mounted to at least one of said right stile and said top rail and presenting at least one recess facing outwardly away from said right stile and said top rail for receiving a portion of said decorative member, a second bar spaced from and opposing said first bar and mounted to at least one of said left stile and said bottom rail and presenting at least one recess facing and opposing said recess of said first bar for receiving a portion of said decorative member, and said first and second bars each having at least one biasing device integrally formed on said first and second bars, said at least one biasing device angularly extending into said respective recesses of said first and second bars and engaging said decorative member for biasing said decorative member outwardly away from said respective stiles and rails to prevent movement of said decorative member relative to said stiles and rails.

2. An assembly as set forth in claim 1 wherein said biasing device of each of said first and second bars is further defined as a cantilevered finger extending into said respective recesses of each of said first and second bars.

3. An assembly as set forth in claim 1 wherein said first bar is mounted to said right stile and said second bar is mounted to said left stile.

4. An assembly as set forth in claim 3 wherein said right and left stiles each have a base having side walls extending therefrom to spaced distal edges to define a channel having a U-shaped cross section with each of said distal edges of said side walls including a flange extending inwardly into said channel of said right and left stiles.

5. An assembly as set forth in claim 4 wherein said first bar is disposed between said flanges and said base of said right stile and said second bar is disposed between said flanges and said base of said left stile.

6. An assembly as set forth in claim 5 wherein each of said right and left stiles include a divider in parallel and spaced relationship with said flanges to define an elongated pocket therebetween for receiving said first and second bars between said flanges and said dividers of said respective right and left stiles.

7. An assembly as set forth in claim 1 wherein each of said first and second bars include a plurality of bar portions.

8. An assembly as set forth in claim 7 wherein each of said bar portions has at least one biasing device disposed in each of said recesses.

9. An assembly as set forth in claim 8 wherein said biasing device of each of said bar portions is further defined as a cantilevered finger extending into said respective recesses of each of said bar portions.

10. An assembly as set forth in claim 9 wherein each of said bar portions include opposing connector ends having at least one male fastener disposed on one of said connector ends and at least one female fastener disposed on said other connector end for fastening said bar portions together to form said first and second bars.

11. An assembly as set forth in claim 1 including a mullion extending between said right and left stiles and spaced between said top and bottom rails for separating at least two decorative members.

12. An assembly as set forth in claim 1 wherein said at least one recess defined by each of said first and second bars is further defined as a plurality of slat recesses with each being elongated along an axis disposed at an angle to the length of said right and left stiles.

13. An assembly as set forth in claim 12 wherein said decorative member is defined by a plurality of slats having a cross section complementary to said slat recesses for retaining said slats within said slat recesses.

14. An assembly as set forth in claim 13 wherein said first bar is mounted to said right stile and said second bar is mounted to said left stile and each of said first and second bars include a plurality of bar portions and each of said bar portions include opposing connector ends each having a shaped end for providing proportionately spaced recesses between each of said bar portions.

15. An assembly as set forth in claim 14 wherein each of said shaped ends of each of said bar portions is further defined as an S-shaped configuration.

16. An assembly as set forth in claim 14 wherein said top and bottom rails each have a shaped side complementary to said shaped ends of said bar portions.

17. An assembly as set forth in claim 14 wherein each of said bar portions has at least one biasing device disposed in each of said slat recesses for biasing each of said slats outwardly away from said respective right and left stiles.

18. An assembly as set forth in claim 1 wherein said decorative member is defined by at least one panel having a periphery disposed in said respective recesses of each of said first and second bars.

19. An assembly as set forth in claim 18 wherein said first bar is mounted to said right stile and said second bar is mounted to said left stile and each of said top and bottom rails define a panel recess for receiving said periphery of said panel.

20. An assembly as set forth in claim 19 wherein said panel is further defined as a first panel having a periphery and disposed adjacent to said top rail and a second panel having a periphery and disposed adjacent to said first panel and said bottom rail with a mullion extending between said right and left stiles and spaced between said first and second panels.

21. An assembly as set forth in claim 20 wherein each of said first and second bars include a plurality of bar portions.

22. An assembly as set forth in claim 21 wherein each of said bar portions has at least one biasing device disposed in each of said recesses for biasing said panel outwardly away from said respective right and left stiles.

23. An assembly as set forth in claim 22 wherein said biasing device is further defined as a cantilevered finger extending into said respective recesses of said bar portions.

24. An assembly as set forth in claim 23 wherein said mullion defines a pair of opposing panel recesses with said periphery of said first panel disposed in said corresponding panel recess of said mullion and said panel recess of said top rail and said periphery of said second panel disposed in said other panel recess of said mullion and said panel recess of said bottom rail.

* * * * *